US006789278B2

(12) United States Patent
Shea

(10) Patent No.: US 6,789,278 B2
(45) Date of Patent: Sep. 14, 2004

(54) PORTABLE DEVICE FOR GENERATING A CURRENT IN A VESSEL

(75) Inventor: Joseph Shea, Clarks Summit, PA (US)

(73) Assignee: North American Manufacturing Company, Incorporated, Scranton, PA (US)

( * ) Notice: Subject to any disclaimer, the term of this patent is extended or adjusted under 35 U.S.C. 154(b) by 0 days.

(21) Appl. No.: 10/351,765

(22) Filed: Jan. 27, 2003

(65) Prior Publication Data

US 2004/0143894 A1 Jul. 29, 2004

(51) Int. Cl.[7] ..... E04H 4/12
(52) U.S. Cl. ..... 4/492; 4/904
(58) Field of Search ..... 4/488, 492, 496, 4/541.3, 559, 904; 440/71, 72, 76, 77, 98; 405/79, 80; 472/128; 482/55

(56) References Cited

U.S. PATENT DOCUMENTS

| | | | | | |
|---|---|---|---|---|---|
| 3,358,635 | A | * | 12/1967 | McRee | 440/72 X |
| 3,674,020 | A | | 7/1972 | Jacuzzi | 4/492 X |
| 3,820,173 | A | | 6/1974 | Weller | 4/496 |
| 4,282,866 | A | * | 8/1981 | Miffitt | 4/492 X |
| 4,352,215 | A | | 10/1982 | Laing | 4/492 |
| 4,561,133 | A | | 12/1985 | Laing | 4/491 |
| 4,665,572 | A | | 5/1987 | Davidson et al. | 4/492 |
| 4,853,124 | A | * | 8/1989 | Terada | 4/492 X |
| 4,907,304 | A | | 3/1990 | Davidson et al. | 4/492 X |
| 4,938,469 | A | | 7/1990 | Crandell | 4/492 X |
| 5,207,729 | A | | 5/1993 | Hatanaka | 4/492 |
| 5,298,003 | A | | 3/1994 | Weihe et al. | 4/492 X |
| 5,367,719 | A | | 11/1994 | Mermelstein | 4/488 |
| 5,597,288 | A | | 1/1997 | Hatanaka | 4/492 X |
| 5,662,558 | A | | 9/1997 | Shannon, III | 4/491 X |
| 5,807,289 | A | * | 9/1998 | Camp | 4/541.3 X |
| 5,947,782 | A | * | 9/1999 | Siladke et al. | 440/72 X |
| 6,030,180 | A | | 2/2000 | Clarey et al. | 417/18 |

* cited by examiner

*Primary Examiner*—Robert M. Fetsuga
(74) *Attorney, Agent, or Firm*—RatnerPrestia

(57) ABSTRACT

A portable device is provided for generating a current in a vessel having a side-wall, the vessel containing a fluid. The device includes a housing having an inlet and an outlet, and a motor attached to the housing. A propeller, driven by the motor, is positioned in the housing. A float is attached to the housing to create a buoyant force sufficient to keep the portable device afloat in the fluid. Fluid is drawn into the housing through the inlet side and forced out of the housing through the outlet side to generate the current in the vessel.

4 Claims, 8 Drawing Sheets

PORTABLE DEVICE FOR GENERATING A CURRENT IN A VESSEL

FIELD OF THE INVENTION

This invention relates to a portable device for generating a current in a vessel containing fluid. More specifically, this invention provides an exercise or recreational device for swimming pool use.

BACKGROUND OF THE INVENTION

Swimming pools installed in or on the grounds of private property owners are generally too small in size for purposes of enabling a user to perform long distance lap swimming. Larger sized pools suitable for long distance lap swimming are expensive to build and maintain. There is a need to convert smaller, inexpensive pools into usage for long distance swimming. Prior devices have been proposed which generate a continuous end-to-end current in a small sized tank against which a swimmer can swim in one relatively stationary place. Such devices are, however, difficult and expensive to manufacture, and comprise a current generating device integral with the swimming pool.

So-called portable current-generating devices typically require support members and mounting hardware. Such a device requires the user to first install it in a pool before it can operate to generate a current. Installation can be cumbersome, and typically requires the use of tools and hardware. Depending upon the size and weight of the unit, installation often requires the efforts of more than one person. Because such an operation takes considerable time and effort, the device is typically left in place in its installed position, in effect becoming a permanent fixture in a swimming pool and detracting from the overall size of the pool.

SUMMARY OF THE INVENTION

The present invention provides a portable device for generating a current in a vessel containing a fluid. The device includes a housing having an inlet and an outlet, and a motor attached to the housing. A propeller, driven by the motor, is positioned in the housing. A float is attached to the housing to create a buoyant force sufficient to keep the portable device afloat in the fluid. Fluid is drawn into the housing through the inlet side and forced out of the housing through the outlet side to generate the current in the vessel.

A further embodiment of the present invention provides a portable device for generating a current in a swimming pool containing water. The device includes a housing having an inlet and an outlet. A propeller, driven by a motor, is positioned in the housing. A float is attached to the housing to create a buoyant force sufficient to keep the portable device afloat in the water. Water is drawn into the housing through the inlet side and forced out of the housing through the outlet side to generate the current in the swimming pool. The buoyant force of the float and the rotation of the propeller stabilize the portable device in the water by positioning the portable device adjacent a side-wall of the swimming pool.

Another embodiment of the present invention provides a method of swimming in a pool against a current. The method includes placing a floating current-generating device into the pool, allowing the floating device to move in the pool to a stabilized position adjacent a side-wall of the pool, and swimming against the current in front of the device.

BRIEF DESCRIPTION OF THE DRAWINGS

The invention will be described with reference to the exemplary embodiments illustrated in the figures, of which.

DETAILED DESCRIPTION OF THE INVENTION

Figure 1:
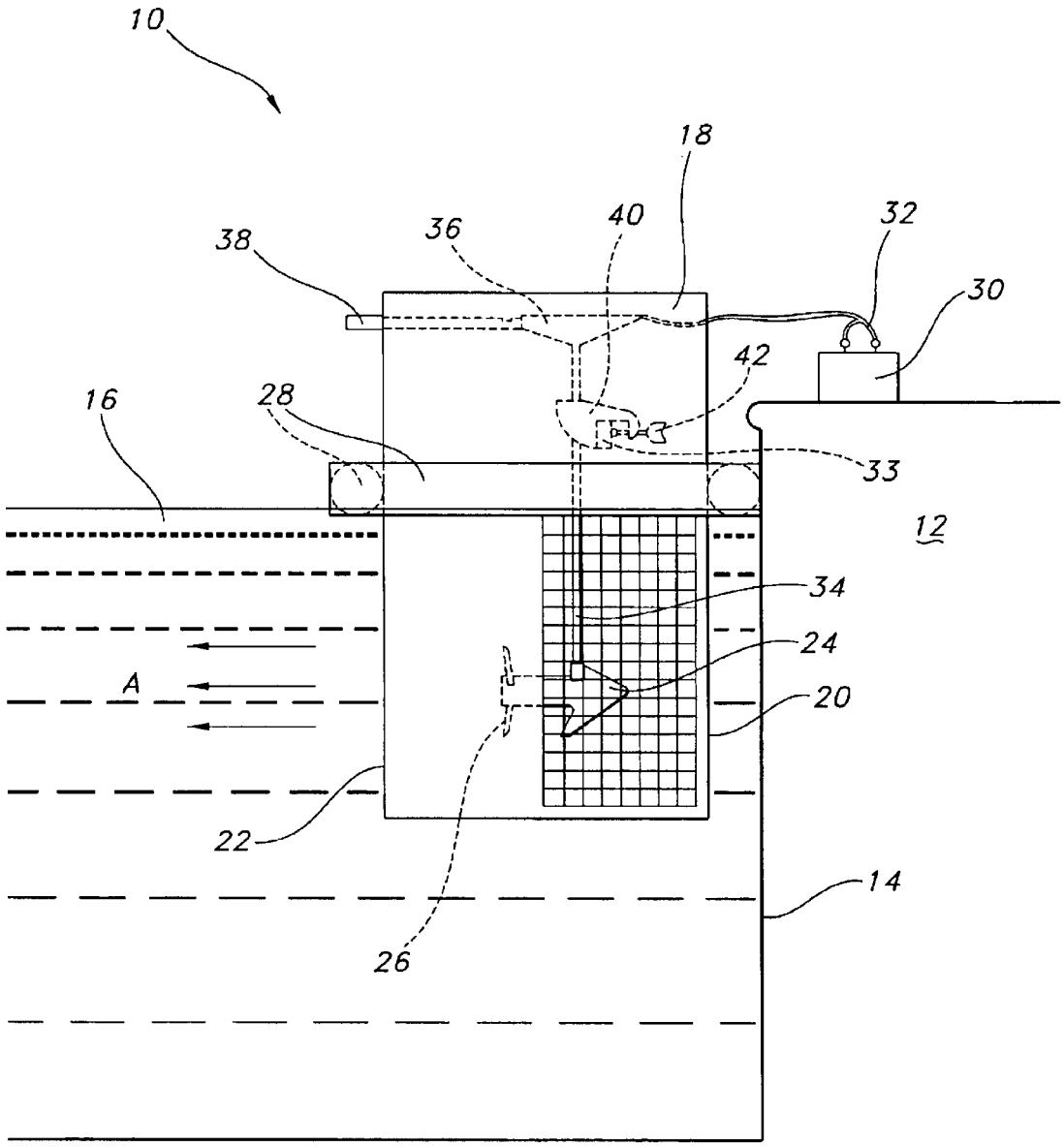
FIG. 1 is a side view of an embodiment of a portable device for generating a current in a vessel in accordance with the present invention, the device positioned adjacent a side-wall of the vessel.

Preferred features of embodiments of this invention will now be described with reference to the figures. It will be appreciated that the spirit and scope of the invention is not limited to the embodiments selected for illustration. Also, it should be noted that the drawings are not rendered to any particular scale or proportion. It is contemplated that any of the configurations and materials described hereafter can be modified within the scope of this invention.

Generally with reference to FIGS. 1–4, a portable device 10 is provided for generating a current "A" in a vessel 12 having a side-wall 14, the vessel 12 containing a fluid 16. The device 10 includes a housing 18 having an inlet with a flat surface 20 and an outlet 22, and a motor 24 attached to the housing 18. A propeller 26, driven by the motor 24, is positioned in the housing 18. A float 28 is attached to the inlet side of the housing 18 to create a buoyant force sufficient to keep the portable device 10 afloat in the fluid 16. Fluid 16 is drawn into the housing 18 through the inlet side 20 and forced out of the housing 18 through the outlet side 22 to generate the current "A" in the vessel 12.

Referring specifically to FIG. 1, an exemplary embodiment of a portable device, generally designated as 10, is illustrated. The motor 24 is powered by a battery 30. The battery 30 is connected to the motor 24 via battery cables 32 which have a length sufficient to allow the portable device 10 to float in the fluid 16 when the battery 30 is placed outside of the vessel 12. The battery 30 may be a marine motor battery, or any other power source capable of providing adequate power safely in an aquatic environment. The present invention is not limited to one battery, as the motor may be powered by two or more batteries. Furthermore, the present invention is not limited to the use of a battery or batteries. Any power source capable of providing adequate power may be utilized.

Figure 2:
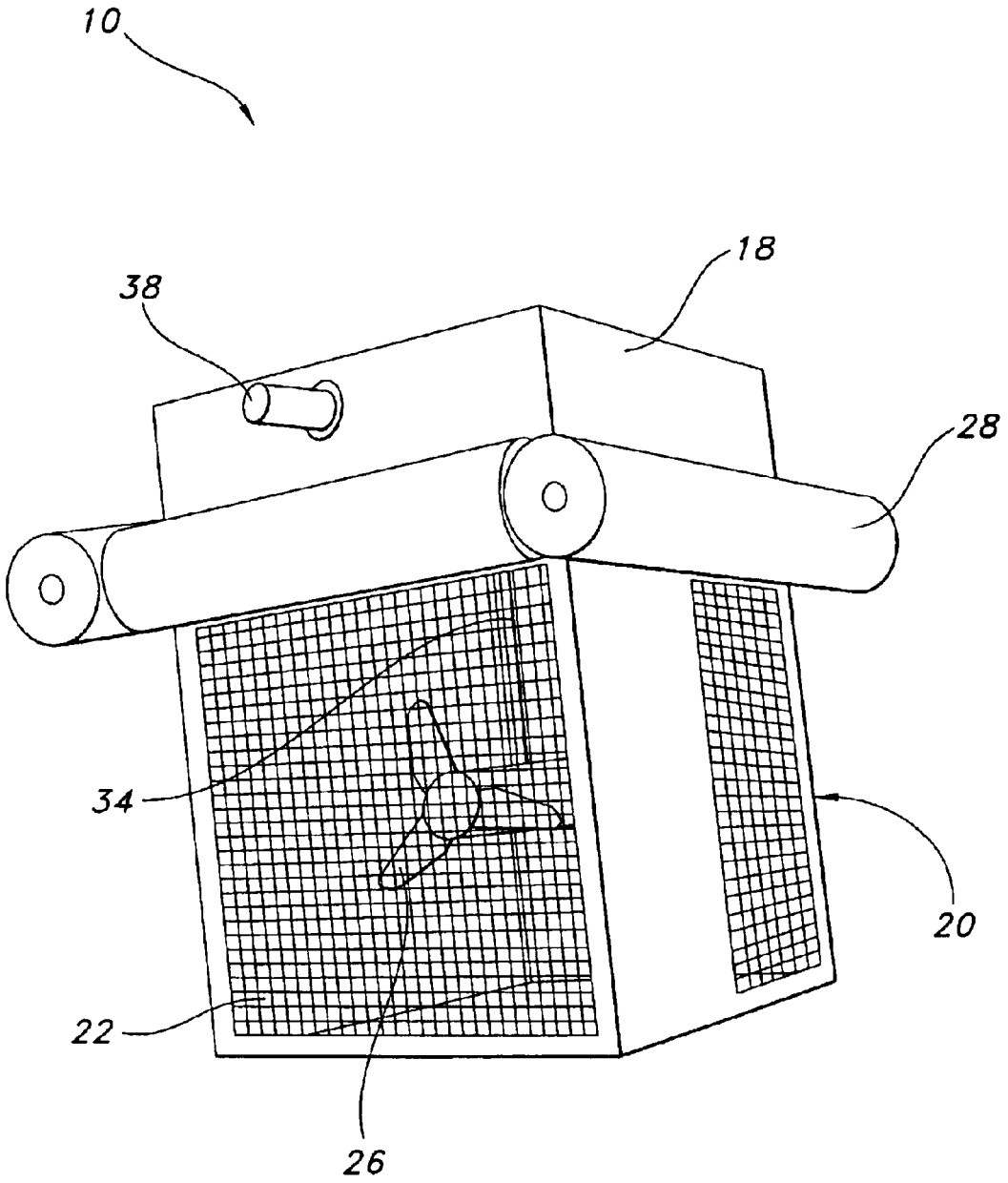
FIG. 2 is a front perspective view of the embodiment of a portable device for generating a current in a vessel illustrated in FIG. 1.
Figure 3:
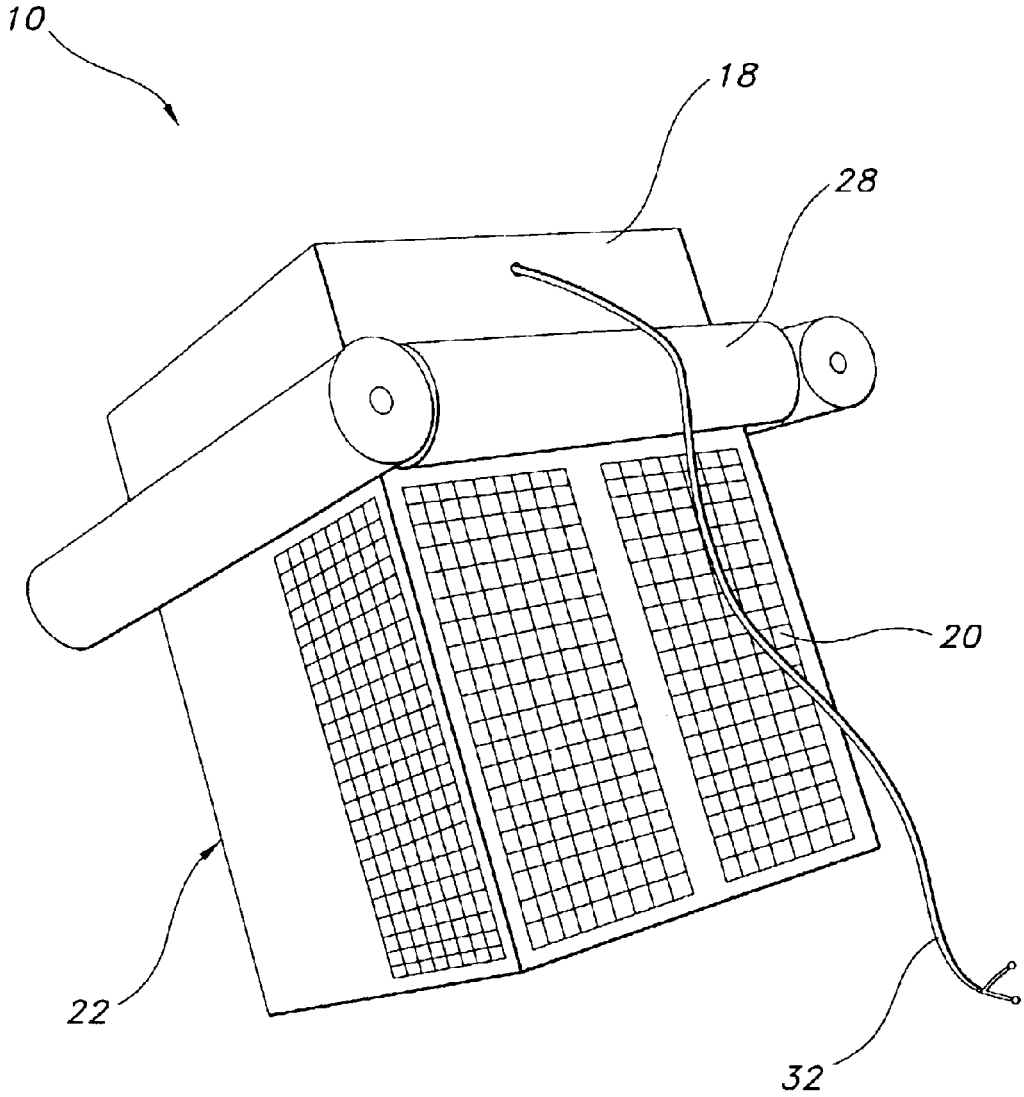
FIG. 3 is a rear perspective view of the embodiment of a portable device for generating a current in a vessel illustrated in FIG. 1.

FIGS. 2 and 3 illustrate that the housing 18 has a cubical shape, wherein the inlet side 20 is disposed opposite the outlet side 22. However, the present invention is not limited to a cubical-shaped housing 18. For example, housing 18 may have a triangular horizontal cross-section, a circular horizontal cross-section, or any other shape that includes an inlet side 20 and an outlet side 22.

Figure 4:
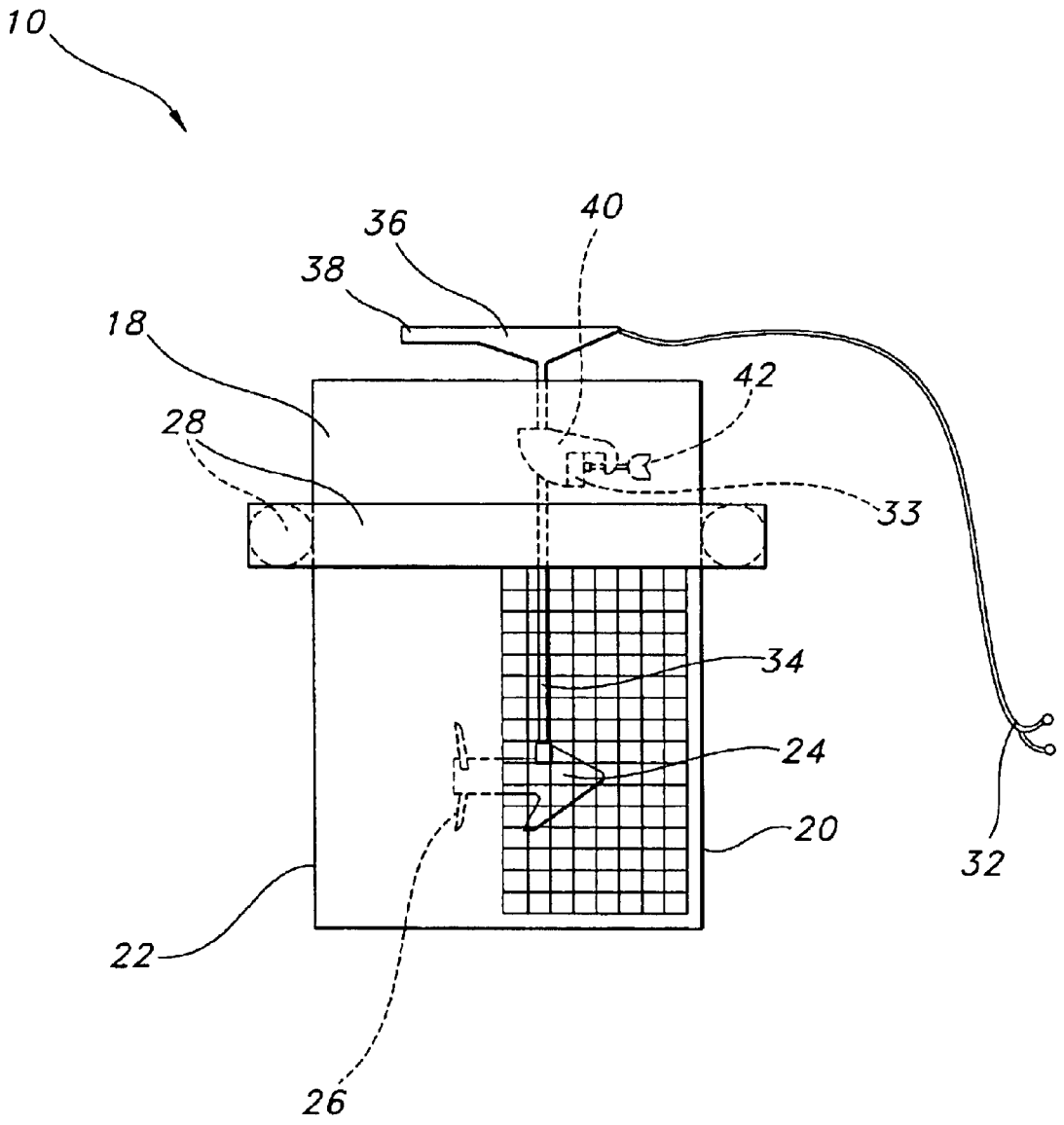
FIG. 4 is a side view of another embodiment of a portable device for generating a current in a vessel in accordance with the present invention.

The inlet side 20 and the outlet side 22 of the housing 18 are each covered with a grating. However, any type of covering that permits the flow of fluid 16 while protecting users from the hazards of the rotating propeller 26 is suitable. A mounting bar 33 extends within the housing 18, the cross-section of which is represented in FIGS. 1 and 4. The mounting bar 33 supports the motor 24 (described subsequently with reference to FIG. 5).

A preferred housing 18 is made from stainless steel sheet metal or powder coated aluminum. However, any non-ferrous and non-corrosive material, metal or plastic, capable of maintaining the rigid structure of the housing 18 is suitable.

FIGS. 1–4 illustrate that the floats 28 are tubular-shaped and are attached to the sides of the housing 18. The present invention is not limited to tubular-shaped floats 28, as a variety of shapes may be utilized. The floats 28 may be made from polyethylene foam, polystyrene, foam rubber, or any other material capable of creating a buoyant force sufficient to keep the portable device 10 afloat in the fluid 16. The floats 28 may also be hollow structures inflated with air to create the necessary buoyant force. Furthermore, the present invention may utilize varying numbers of floats 28 attached to the sides of the housing 18. Alternatively, one continuous float 28 may be attached around the perimeter of the housing 18.

Figure 5:
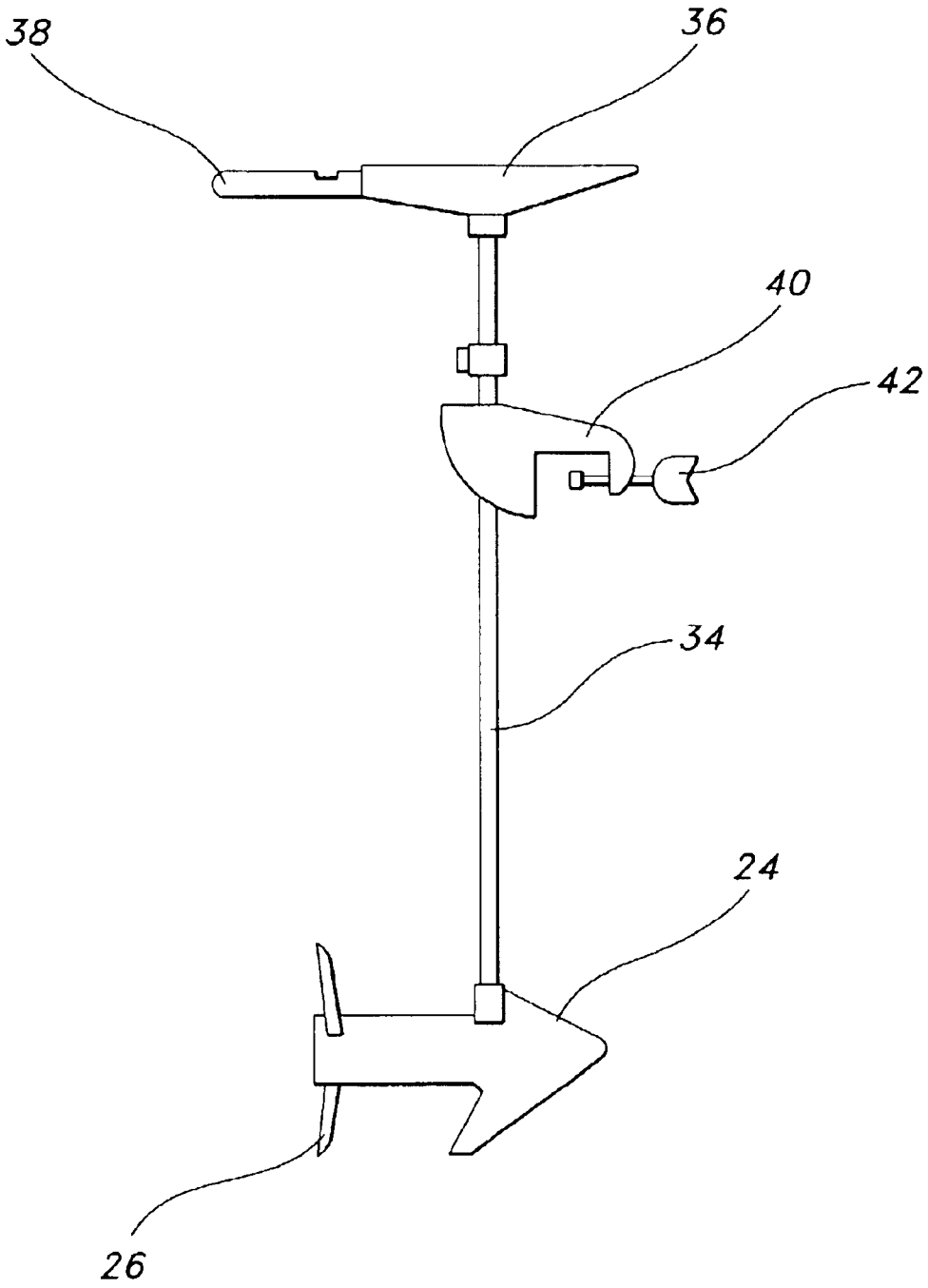
FIG. 5 (Prior Art)
FIG. 5 is a side view of a motor, propeller, and speed control device in accordance with the prior art.

Referring specifically to FIG. 5, the propeller 26 is attached to the motor 24. A speed control device 36 is attached to the motor 24 via a shaft 34. A C-clamp 40 including a securing bolt 42 is attached to the shaft 34. The motor 24 is secured to the mounting bar 33 via the C-clamp 40 and securing bolt 42. The speed control device 36 is mounted within the housing 18, as illustrated in FIG. 1, or outside of the housing 18, as illustrated in FIG. 4.

The speed control device 36 includes a speed control throttle 38. Manipulation of the speed control throttle 38 adjusts the rotational speed of the propeller 26. FIGS. 1–3 illustrate the speed control throttle 38 extending through the outlet 22 side of the housing 18. FIG. 4 illustrates the speed control throttle 38 mounted above the top portion of the housing 18. Such motors are commercially available and are typically referred to as electric trolling motors, such as those used on small fishing boats. Any such motor would be generally suitable for use with the present invention.

Figure 6:
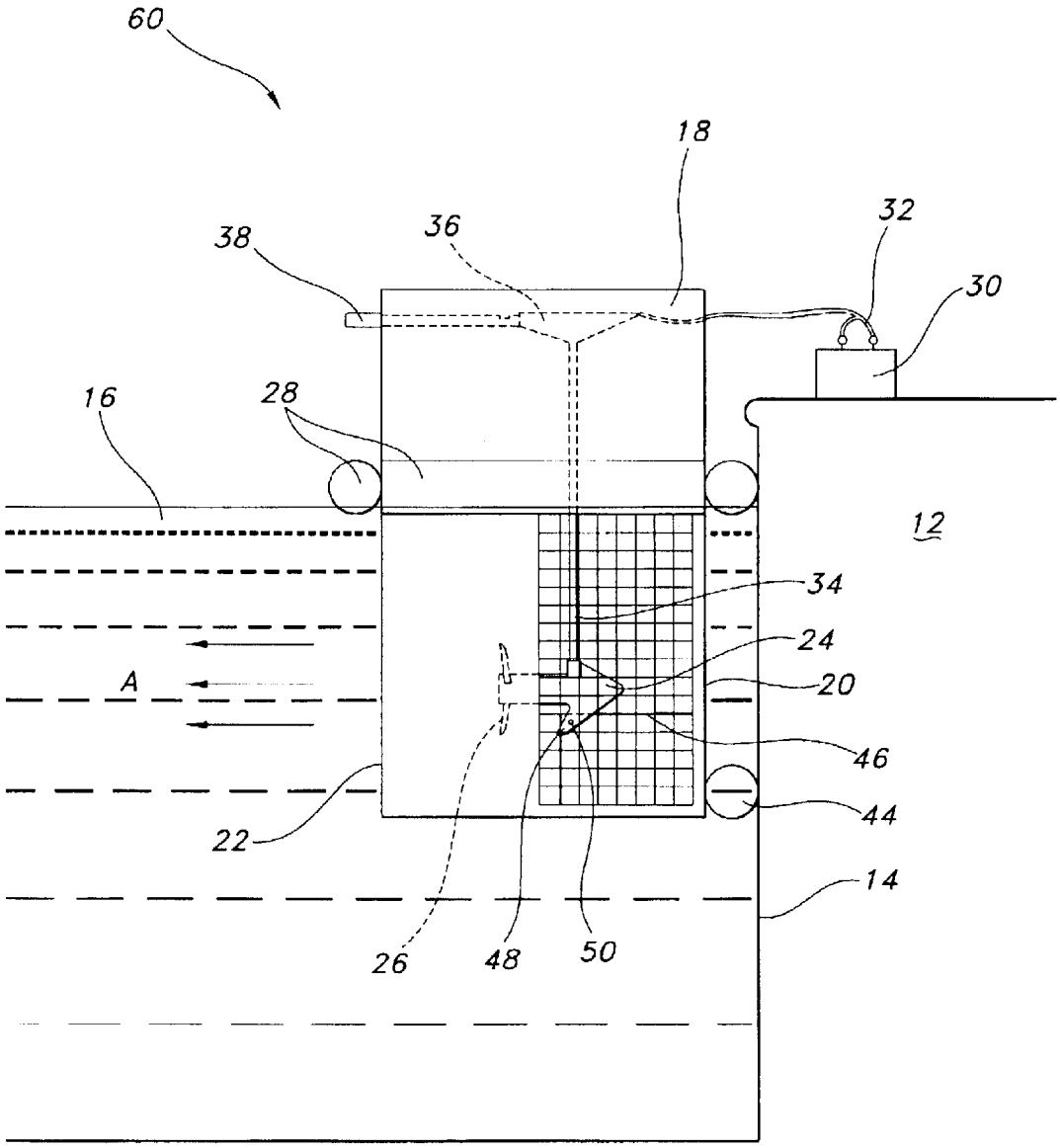
FIG. 6 is a side view of a further embodiment of a portable device for generating a current in a vessel in accordance with the present invention, the device positioned adjacent a side-wall of the vessel.
Figure 7:
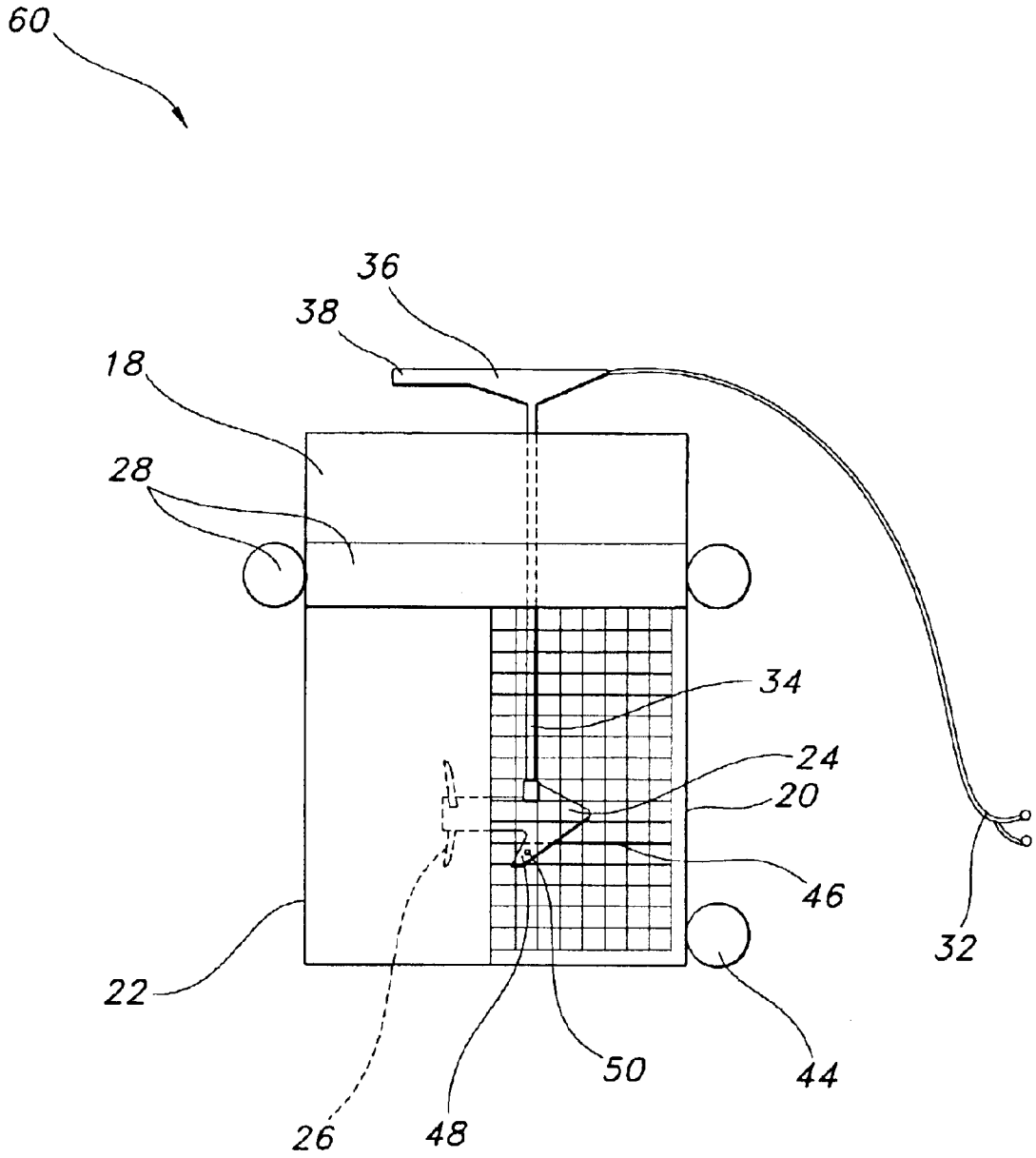
FIG. 7 is a side view of another embodiment of a portable device for generating a current in a vessel in accordance with the present invention.

Referring next to FIGS. 6 and 7, a further exemplary embodiment of a portable device, generally designated as 60, is illustrated. The function and operation of the portable device 60 illustrated in FIGS. 6 and 7 is virtually the same as that of portable device system 10, described previously with reference to FIGS. 1–5, with some notable differences in configuration.

As illustrated in FIGS. 6 and 7, a support plate 46 is mounted in the interior of the housing 18. The motor 24 includes a fin 48. Unlike the C-clamp mounting configuration of portable device 10 described previously with reference to FIGS. 1, 4, and 5, portable device 60 is mounted within the housing 18 via the support plate 46. More specifically, fin 48 of motor 24 is secured to the support plate 46 at or around point 50. The attachment at point 50 may consist of a rivet, a mating nut and bolt, a weld, or any other configuration that adequately secures the motor 24 within the housing 18.

FIGS. 6 and 7 also illustrate a tubular-shaped bumper 44, attached to the bottom of the inlet 20 side of the housing 18. When the portable device 60 is positioned adjacent the side-wall 14 of the vessel 12 as illustrated in FIG. 6, the bumper 44 prevents the housing 18 from contacting the side-wall 14, thereby helping to prevent damage to the side-wall 14. Similar to the floats 28 previously described with reference to FIGS. 1–4, the present invention is not limited to a tubular-shaped bumper 44, as a variety of shapes may be utilized. The bumper 44 may be made from polyethylene foam, polystyrene, foam rubber, or any other material capable of providing a cushion to prevent the portable device 60 from contacting the side-wall 14. The bumper 44 may also be a hollow structure inflated with air to create the necessary cushion shape. Furthermore, the present invention is not limited to one bumper 44 along the length of the side, but may have a number of bumpers 44 of varying lengths mounted along the length of the side.

Figure 8:
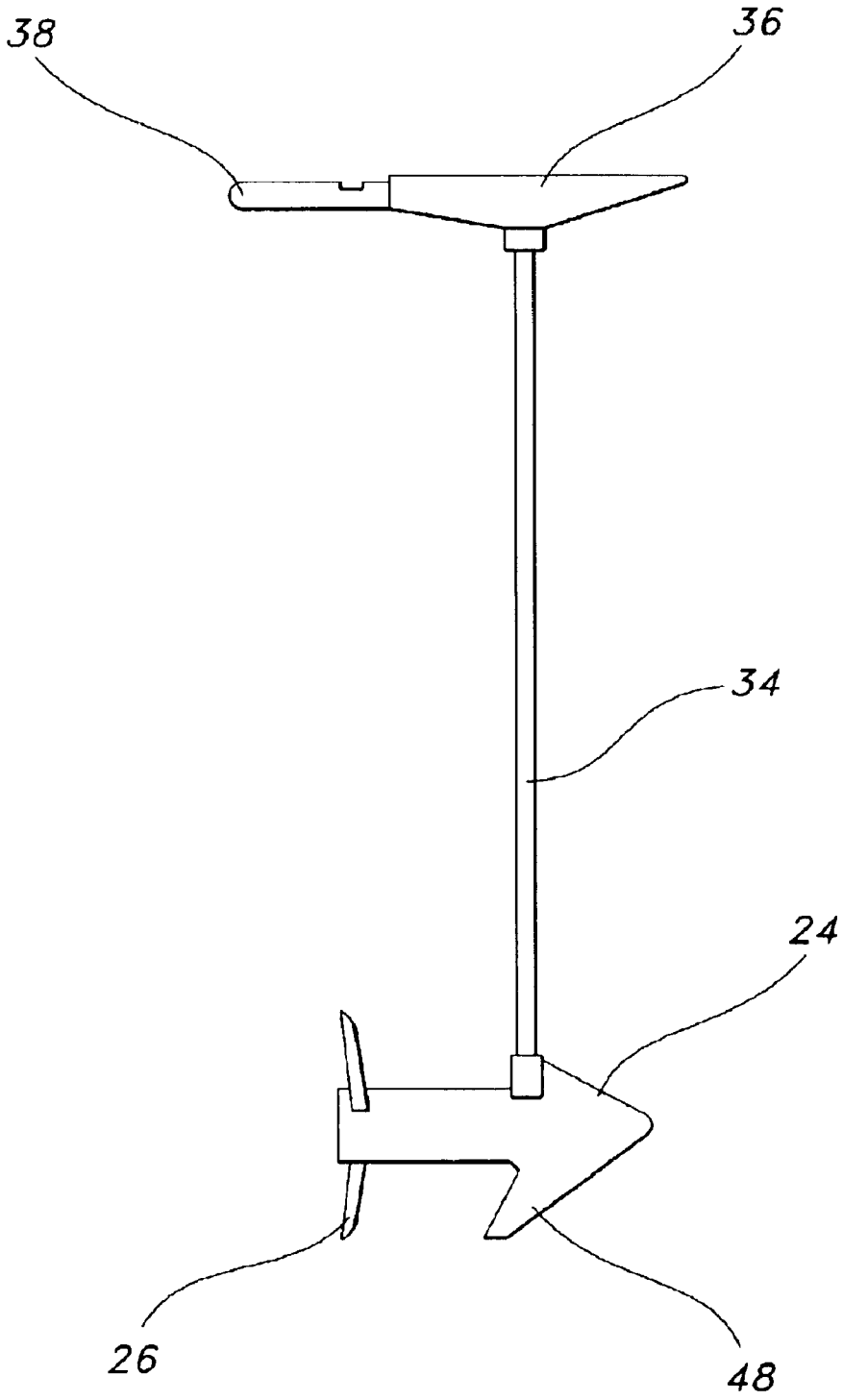
FIG. 8 (Prior Art)
FIG. 8 is a side view of another motor, propeller, and speed control device in accordance with the prior art.

Referring specifically to FIG. 8, the propeller 26 is attached to the motor 24. A speed control device 36 is attached to the motor 24 via a shaft 34. FIG. 8 illustrates the fin 48 attached to the motor 24. As described previously with reference to FIGS. 6 and 7, the fin 48 of the motor 24 is secured to the support plate 46 to mount the motor 24 within the housing 18. The speed control device 36 is mounted within the housing 18, as illustrated in FIG. 6, or outside of the housing 18, as illustrated in FIG. 7.

An application of the present invention is as an exercise or recreational device for swimming pool use. In such an embodiment, the swimming pool is vessel 12, a side-wall of the swimming pool is side-wall 14, and the pool's water is fluid 16. In use, a person places the portable device 10, 60 in a swimming pool 12 containing water 16. The device 10, 60 is truly portable, can be handled by one person, and requires no support members, tools, or mounting hardware. As a result of such portability, the device 10, 60 is easily removed from the swimming pool 12 after use, avoiding becoming in effect a permanent fixture and detracting from the overall size of the pool 12.

Once the portable device 10, 60 is placed in the swimming pool 12, the floats 28 keeps the portable device 10, 60 afloat in the water 16. During operation, the motor 24 is energized by the battery 30 via the battery cables 32, and a rotational force is transmitted to the propeller 26. The rotational force of the propeller 26 causes water 16 to be drawn into the housing 18 through the inlet side 20 and forced out of the housing 18 through the outlet side 22. The buoyant force of the floats 28 and the rotation of the propeller 26 stabilize the portable device 10, 60 in the water 16 by positioning the portable device 10, 60 adjacent a side-wall 14 of the swimming pool 12. In other words, wherever the portable device 10, 60 is placed in the swimming pool 12, it automatically propels itself to a side-wall 14 of the pool 12, with the float 28 and the bumper 44 acting as bumpers between the housing 18 and the side-wall 14 as illustrated in FIG. 1, the user may then swim, in place, in front of the outlet side as water is passed across the user's body. In other words, the user may perform long distance lap swimming n a relatively small area of the swimming pool 12.

The water 16 that is drawn into the housing 18 through the inlet side 20 and forced out of the housing 18 through the outlet side 22 generates the current "A" in the swimming pool 12. The velocity of the current "A" is a function of the rotational speed of the propeller 26. The rotational speed of the propeller 26 may be adjusted by manipulation of the speed control throttle 38, resulting in a fast current "A" during high-speed propeller 26 rotation, and a slow current "A" during low-speed propeller 26 rotation.

A further embodiment of the present invention is a method of swimming in a pool against a current. The method includes placing the floating current-generating device 10 into the pool 12. The user then allows the floating device 10 to move in the pool 12 to a stabilized position adjacent a side-wall 14 of the pool 12. The user may then swim against the current "A" in front of the device 10.

Although the invention is illustrated and described herein with reference to specific embodiments, the invention is not intended to be limited to the details shown. Rather, various modifications may be made in the details within the scope and range of equivalents of the claims and without departing from the invention. For example, the application of this invention is not limited to swimming pools, but may also include test tanks for fluid dynamics experimentation, or other current-generating applications in which a portable device 10, 60 may be beneficial.

What is claimed:

1. A portable device for generating a current in a swimming pool containing water, the portable device comprising:

a housing having an inlet side and an outlet side, wherein said inlet side comprises a flat surface;

a motor positioned in said housing;

a mounting bar for mounting said motor within said housing;

a propeller positioned in said housing, said propeller driven by said motor;

a float attached to said inlet side of said housing to create a buoyant force sufficient to keep said portable device afloat in the water; and a battery located outside said housing and flexibly connected to said motor via battery cables which have a length sufficient to allow said housing containing said motor and propeller to float in the water independent from said battery, wherein water is drawn into said housing through said inlet side and forced out of said housing through said outlet side to generate the current in the swimming pool, and the buoyant force of said float and the rotation of said propeller stabilize said portable device in the water by positioning said portable device adjacent a side-wall of the swimming pool.

2. The portable device of claim 1 wherein said motor has a speed control throttle.

3. The portable device of claim 1 wherein said housing has a cubical shape and said inlet side is disposed opposite said outlet side.

4. The portable device of claim 1 wherein said float is tubular-shaped polyethylene foam attached to the sides of said housing.

* * * * *